US005418036A

United States Patent [19]

Tokikawa et al.

[11] Patent Number: 5,418,036

[45] Date of Patent: May 23, 1995

[54] TILE APPLICATION BACKING MATERIAL AND TILE APPLICATION EXECUTION METHOD

[75] Inventors: Kazuhiko Tokikawa; Teruo Azuma; Hisakazu Komi, all of Suita, Japan

[73] Assignee: Fukuyi Chemical Industry Co., Ltd., Fukui, Japan

[21] Appl. No.: 978,803

[22] Filed: Nov. 19, 1992

[30] Foreign Application Priority Data

Nov. 25, 1991 [JP] Japan ..... 3-96583 U
Nov. 25, 1991 [JP] Japan ..... 3-309435
Jul. 2, 1992 [JP] Japan ..... 4-175163

[51] Int. Cl.[6] ..... E04F 13/08

[52] U.S. Cl. ..... 428/120; 52/384; 52/386; 52/388; 52/581; 52/660; 404/35; 404/36; 404/134; 428/44; 428/45; 428/52; 428/131; 428/134; 428/192

[58] Field of Search ..... 428/120, 119, 44, 45, 428/52, 131, 134, 192; 52/388, 386, 384, 660, 581; 404/35, 36, 134

[56] References Cited

U.S. PATENT DOCUMENTS 489,914 1/1893 Ams ..... 52/388
4,590,731 5/1986 DeGooyer ..... 52/581
4,888,928 12/1989 Rea ..... 52/387

FOREIGN PATENT DOCUMENTS 682615 3/1964 Canada ..... 52/387
0206559 5/1986 European Pat. Off. .
1187185 9/1959 France ..... 52/384
2612546 9/1988 France .
2533733 7/1975 Germany .
63-289160 11/1988 Japan .
1304257 12/1989 Japan .
579693 9/1976 Switzerland ..... 52/384

*Primary Examiner*—Nasser Ahmad
*Attorney, Agent, or Firm*—Biebel & French

[57] ABSTRACT

A tile application backing material is disclosed having as an object thereof to greatly simplify tile allocation, positioning, and affixing and the like, and to strongly affix tiles and backing material to a laying surface; in order to achieve this object, this tile application backing material is formed with a plurality of frame members disposed extending along sides of tiles having a polygonal shape, said frame members being connected at mutual points of intersection; these frame members comprise a base portion which is in contact with a laying surface and dividing plate portions which are disposed thereabove. By means of this, after allocation has been determined by means of this backing material, in a state in which this backing material is temporarily attached to a laying surface to which tiles are to be applied, adhesive is allowed to flow into a plurality of regions demarcated by means of the dividing plate portions and by means of the inlaying of tiles, tile application is easily accomplished.

8 Claims, 16 Drawing Sheets

TILE APPLICATION BACKING MATERIAL AND TILE APPLICATION EXECUTION METHOD

BACKGROUND OF THE INVENTION

1. Field of Use in Industry

The present invention relates to a tile application backing material which facilitates the application of tiles, as well as to a tile application execution method using this backing material.

1. Technological Background

Conventionally, among construction methods which facilitated tile affixing operations, a tile attachment method disclosed in Japanese Patent Application, Second Publication, Sho 63-289160 was known, in which a dry construction method was used in which a board having tiles affixed thereto in advance was attached on-site, and furthermore, the difficulties of the on-site adjustment in this dry construction method were solved.

This tile attachment method utilized a tile mat comprising hardened rubber or the like and having formed therein a plurality of tile engaging grooves; in this method, the tile mat was set and attached on-site at the position at which tiles were to be laid, and tiles were inlaid in these tile engaging grooves and attached. Here, stringing operations or the like for the purpose of allocating tile attachment positions are not necessary, as was the case with the dry construction method referred to above, and in addition, on-site setting is easily accomplished, so that a high degree of skill is not required of the operator.

However, in the method using the above tile mat, it is obvious that when the tiles are merely engaged in the tile mat, they can be easily removed by an outside force, and even if the tiles are attached in such a manner that adhesive is applied to the lower surface thereof, each tile is attached only to the tile mat, which is flexible, so that it is difficult to maintain the strength required for maintaining the optimum tile attachment position.

That is to say, in the case in which the tile mat is attached by means of a lapped flat seam or the like, if, for example, the tile mat is deformed as a result of changes in temperature or humidity or the like, there is a possibility that the tile will, together with the tile mat, partially lift away from the laying surface. In addition, it is possible, for example, to reduce the possibility of this occurring by adhering the entire tile mat to the laying surface; however, in this case, the amount of work involved in the application of the adhesive increases, the amount of adhesive required increases greatly, and in addition, the tile mat cannot be easily removed, so that reallocation and the like becomes difficult, and the ease of the laying operation, which is the primary beneficial characteristic, is reduced. That is to say, with the conventional tile mat as described above, it was impossible to avoid these types of difficulties and to attach the tiles so that they would not lift away from the backing.

Furthermore, the tile engaging grooves described above were simple rectangular concavities, so that it was necessary to consider the amount of adhesive used when inlaying tiles, so that with respect to this point, skill was required. That is to say, in order to adhere the tiles to the tile mat with a high degree of reliability, it was necessary to place adhesive in the interstices around the tiles, and as a result of this, when the tiles were inlaid, only that amount of adhesive sufficient to cause extrusion of adhesive into the periphery of the tiles is necessary; however, if there is excess adhesive, adhesive will extrude to the surface of the tiles, and the finishing of the surface will be difficult. Furthermore, it is necessary to standardize the amount of adhesive in each concavity, so that the amount of adhesive must be controlled for each concavity in accordance with the size of the tiles.

A method for the laying of tiles in which a framework comprising bars assembled into a lattice form was applied to the laying surface of the tiles, the spaces formed by this framework were used for allocation, and the tiles were laid, was disclosed in Japanese Patent Application, First Publication, Laid-open No. Hei 1-304257. This method was characterized in that there were no problems such as the lifting away of the tile mat, and moreover, allocation by means of stringing and the like was not necessary; however, the guiding functions of the framework at the time of the positioning of the tiles were extremely poor, and it was not a method by which the laying of the tiles could be easily accomplished by an unskilled worker, as the operation required was not a simple one such as the inlaying of tiles.

Furthermore, this type of tile application backing material consists of connecting portions providing connectivity to another adjoining tile application backing material. Using the connectivity at the various connecting portions, the tile application backing materials can be made to correspond to a laying surface over a wide extent.

As shown in FIG. 35, the connecting portion 101 of the tile application backing material is formed by a dividing plate portion 103 with a base portion 102, and a plate portion 105 with penetrating holes 104 into which can be fitted the base portion 102 of the dividing plate portion 103.

Thus, because the plate portion 105 is stacked on the upper part of the dividing plate portion 103, and the base portion 102 of the dividing plate portion 103 is fitted into the penetrating holes 104 of the plate portion 105, the tile application backing material can be connected.

However, in this type of tile application backing material, when connection occurs at the connecting portion 101, the plate portion 105 is tacked on the upper part of the dividing plate portion 103. At the stacking point, the adhesive does not easily flow onto the laying surface, and the connecting portion 101 will peel off of the laying surface; thus tile application might not be effective using this method.

SUMMARY OF THE INVENTION

The present invention was created in light of the conditions in the technological background described above; it is an object thereof to provided a tile application backing material which greatly simplifies the allocation, positioning, and adhering of tiles, makes possible a laying operation which is easily accomplished even by an unskilled worker, and which realizes a strong attached state of the tiles with respect to the backing.

The present invention provides a tile application backing material in which a plurality of frame members are disposed extending along the sides of tiles having a polygonal shape, these frame members formed so as to be mutually connected at intersections thereof, these frame members comprising a base portion which is in contact with the laying surface and dividing plate portions which are disposed vertically with respect to this base portion.

The present invention further provides a tile application backing material, comprising base portions in contact with a laying surface to which tiles are to be affixed, and dividing plate portions disposed vertically above the base portions and demarcating a plurality of space into which polygonal tiles are fitted, wherein the base portions are formed with a belt plate shape by forming polygonal penetrating holes in each space and assume an overall form of a lattice, intersection points of the base portions formed with a belt plate shape are defined by flat plate portions formed with a flat plate shape, the dividing plate portions are formed so as to have a height so as to be covered by joints between tiles fitted into each of the spaces, and notches for inflow and outflow of adhesive are formed in the dividing plate portions in upper end sides thereof.

In accordance with the backing material of the present invention, after allocation has been determined by means of this backing material, in a state in which the backing material is temporarily affixed to a surface to which tile is to be applied, adhesive is allowed to flow into the plurality of regions demarcated by means of the dividing plate portions, tiles are inlaid, and thereby, tile application can be easily accomplished.

That is to say, in the backing material of the present invention, a plurality of regions for the inlaying of tile are demarcated by means of the frame members, so that by the timely cutting of this backing material and the arrangement and attachment thereof to the laying surface on which tile is to be laid, it is possible to make an approximation of the finished form and to conduct allocation, so that a stringing operation is not necessary.

Furthermore, by forming the frame members with an inverted T shape in the cross section thereof, the strength of the frame members themselves is increased, and the base portion causes the formation of a space between the tile and the laying surface, so that an adhesive flows therein and maintains the attachment between the tile and the laying surface.

In addition, the dividing plate portions are disposed vertically with respect to the laying surface, so that when the tiles are inlaid, these dividing plates function as positioning guides for the tile, and even if, for example, the laying surface is a vertical surface, the inlaid tiles will be reliably supported by the dividing plate portions until the hardening of the adhesive, so that the tiles will not change in position or fall out.

Furthermore, the dividing plates, which are in a fixed state with respect to the regions in which the plurality of tiles are inlaid, form the tile joints, so that the finished divisions accurately form the desired pattern. (That is to say, the joints have a consistent form.)

Furthermore, by means of forming notches in the above dividing plate portions for the purpose of the inflow or outflow of adhesive, it is possible for the tile adhesive to escape to a peripheral region from a region in which a tile is inlaid by means of a notch, and the adhesive flowing onto the backing material flows into or out of each space between regions before hardening, so as to achieve overall uniformity. For this reason, there is no reason to take into account the amount of adhesive into each region into which tiles are inlaid; instead, this amount can be adjusted to the appropriate amount for all regions.

Furthermore, connection portions are formed at side portions of the base portions, and by mutually connecting these, base portions can be connected extremely easily for use as a large backing material.

Furthermore, the present invention provides the type of tile application backing material described below. That is to say, a plurality of frame members are disposed extending along the sides of tiles having a polygonal shape, and are integrally formed so as to be connected at intersections thereof, and in a polygon enclosing one tile, tile support portions are formed in the vicinity of at least 2 intersections extending from frame members between the tile and the laying surface, so as to form a space between the tile and the laying surface to which adhesive is to be supplied; furthermore, elongated holes for filling with adhesive are formed in a penetrating manner in the inner portions of frame members in which tile support portions are formed and along the axis thereof.

In the present invention, tile support portions are formed extending from frame members between tiles and the laying surface so as to form a space between the tile and the laying surface, adhesive flows into this space, and the adhesion between the tile and the laying surface is maintained. Furthermore, elongated holes are formed in a penetrating manner in the frame members having formed thereon tile support portions and along the axes thereof, and adhesive flows into these elongated holes, so that adhesion is further strengthened.

In addition, the present invention also provides the following execution method. That is to say, a tile application backing material, which demarcates a plurality of spaces for the support of the tiles in a state in which the tiles are laid on a laying surface, and in a state in which the lower surfaces of the tiles oppose the laying surface, is constructed in advance, and after this is temporarily held in position on the laying surface, adhesive (fixative) is supplied to the spaces, and furthermore, tiles are placed on these spaces, and by means of the hardening of the adhesive, the tile application backing material and the tiles are affixed to the laying surface.

PREFERRED EMBODIMENTS OF THE INVENTION

Hereinbelow, explanation will be given with regard to the preferred embodiment of the tile application backing material of the present invention.

Hereinbelow, the preferred embodiment of the present invention will be explained based on FIGS. 1–5.

Figure 1:
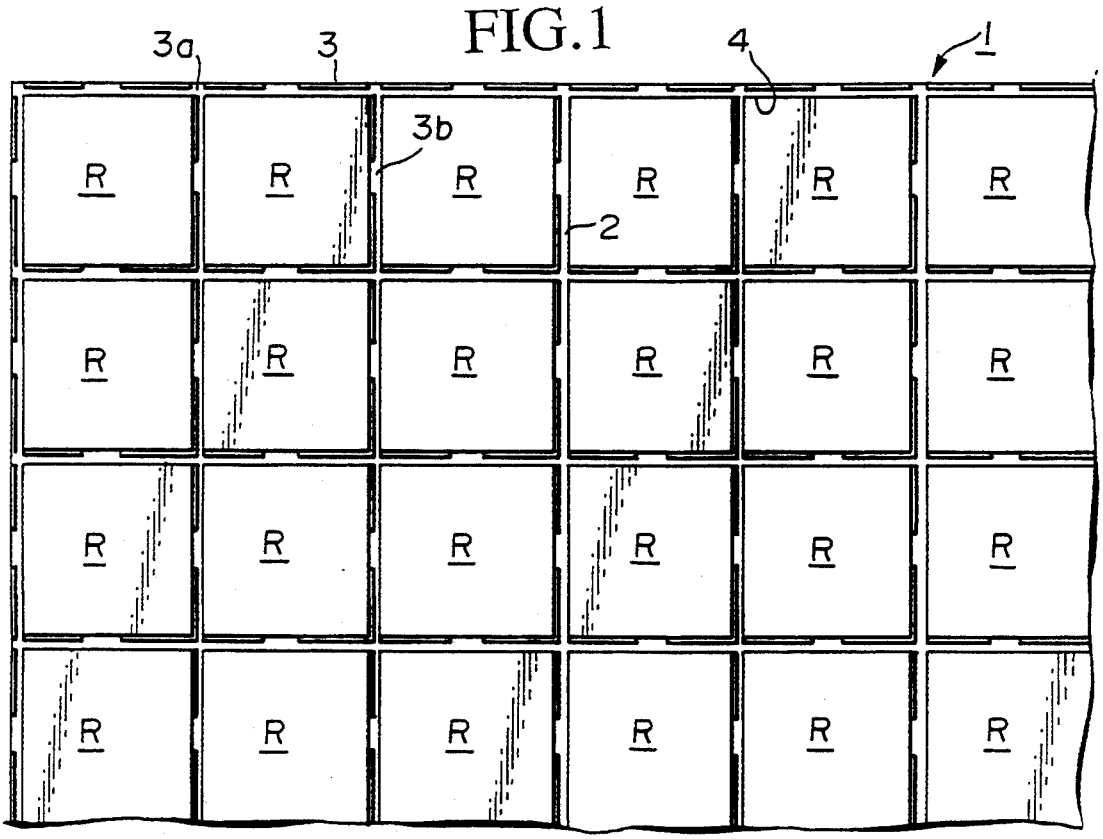
FIG. 1 is a top view of a backing material which explains the state of the tile application backing material of the first preferred embodiment.
Figure 2:
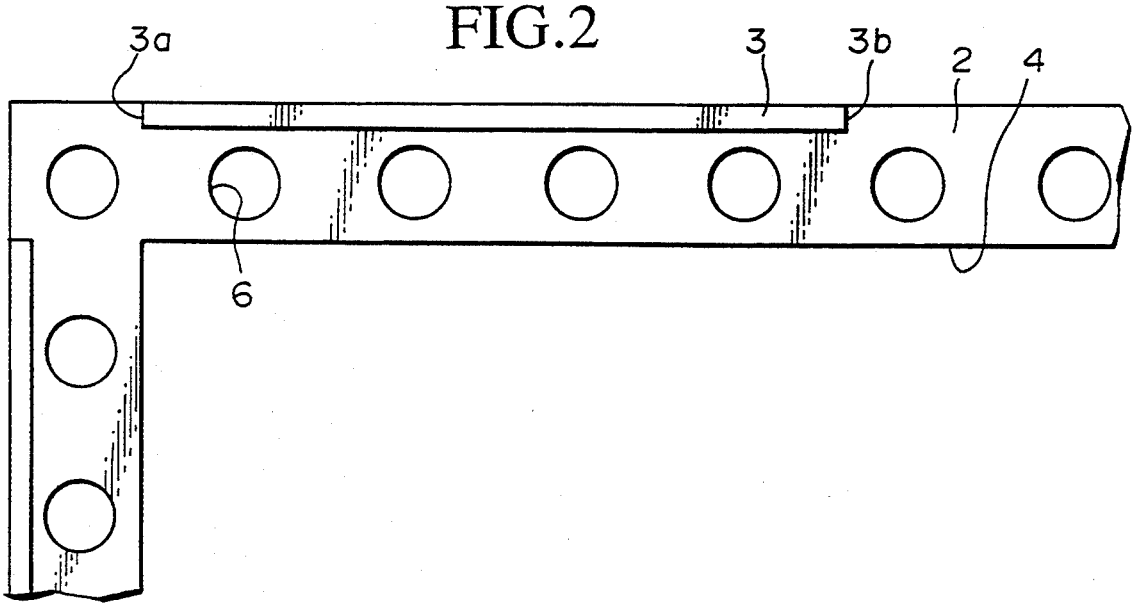
FIG. 2 is. a top view of a backing material in which a portion of the backing material has been enlarged.
Figure 3:
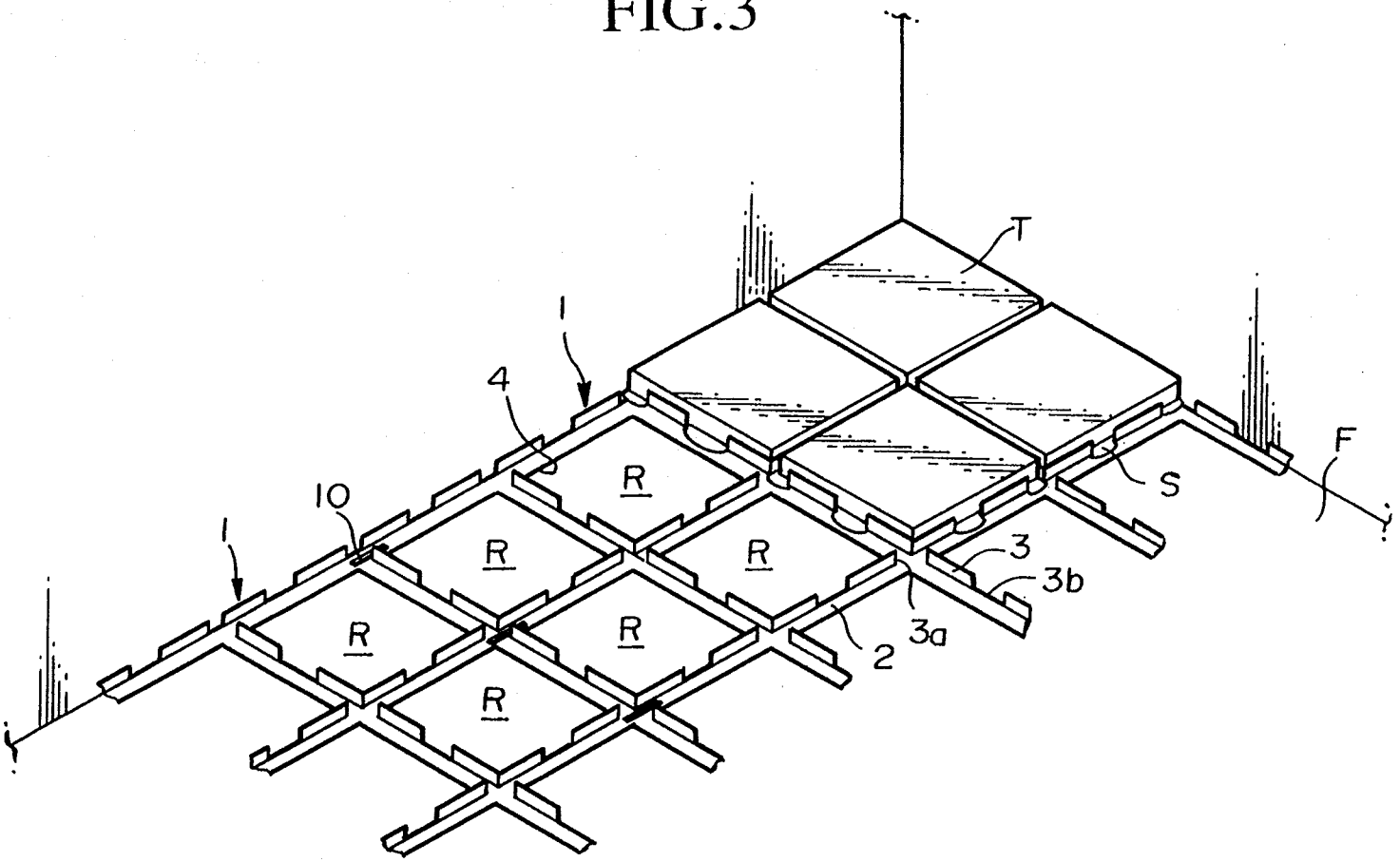
FIG. 3 is an elevated view showing a state in which a tile application operation is conducted using the backing material.

FIG. 1 is a top view of the tile application backing material 1 (hereinbelow referred to as "backing material 1") of the present preferred embodiment, FIG. 2 is a partially enlarged view of FIG. 1, and FIG. 3 is an elevated view showing the state in which a tile application operation is conducted using backing material 1.

Backing material 1 comprises a base portion 2, which is attached to the laying surface F to which tiles are to be applied, and dividing plate portions 3 which are disposed vertically with respect to this base portion 2 and which demarcate a plurality of rectangular regions R in which tiles T are laid.

Base portion 2 is formed with an overall lattice shape, and an angular hole 4 is formed in each region R; as shown in FIG. 2, a plurality of round holes 6 are formed at fixed intervals along the circumference of angular hole 4 (that is to say, in the belt plate portion forming the lattice).

Figure 5:
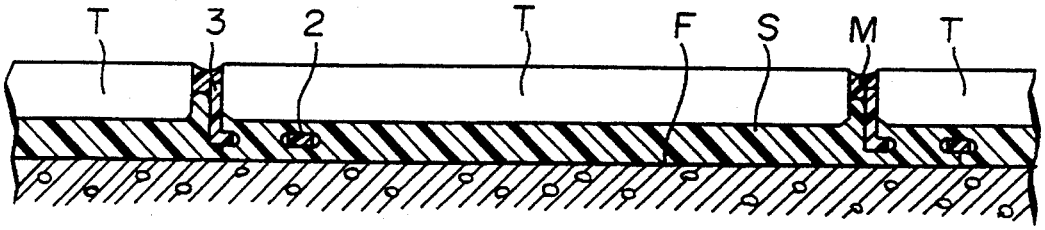
FIG. 5 is a cross sectional view of a floor showing a state in which tile application has been completed.

As shown in FIG. 5, dividing plate portions 3 are of such a height as to be covered by the joints of the tiles when tiles are inlaid into regions R, so that notches 3*a* and 3*b* are formed at a position in the corner of each angular hole 4 and at a position in the center thereof.

This backing material 1 is constructed with an integral formation using, for example, a material such as resin or the like, and can be easily cut.

Although not depicted in the diagram, a plurality of projections are formed on the rear surface of base portion 2 of this backing material 1 with, for example, gaps therebetween, and by means of this, in the state in which backing material 1 is attached to laying surface F, a slight gap is achieved between base portion 2 and laying surface F. Furthermore, the dimensions of the above regions R are set so as to be slightly larger than those of tile T.

If the backing material 1 having the structure described above is used, tile application can be easily conducted as follows.

Figure 4:
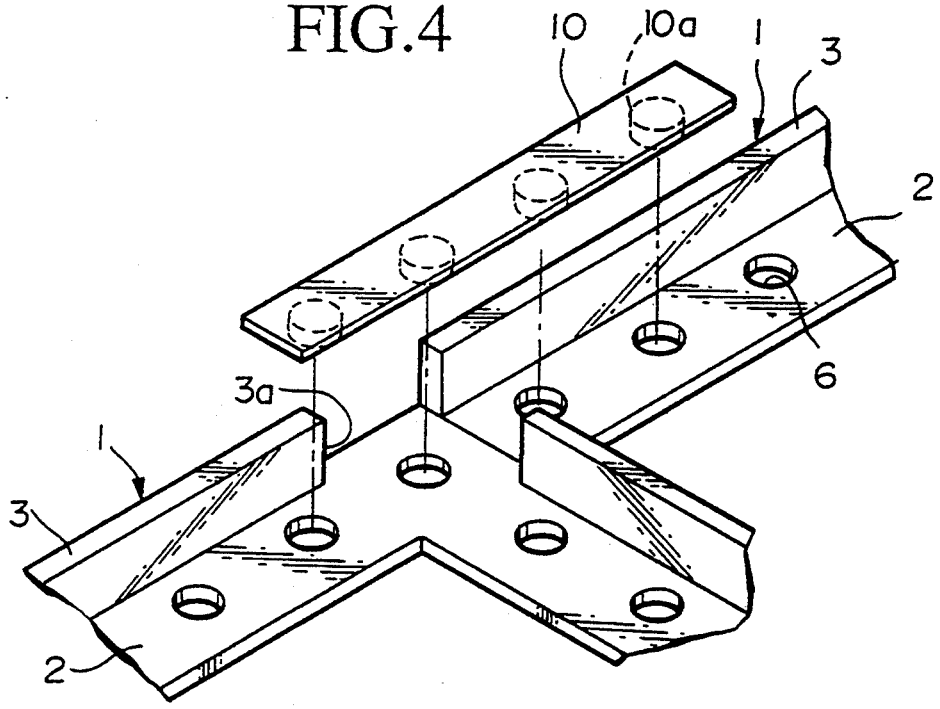
FIG. 4 is an elevated view of a backing material in which a portion of the backing material is enlarged.

That is to say, first, the backing material 1 is cut in a timely fashion, arranged, and applied to the laying surface F, an approximation is made of the finished form, and allocation is conducted. At this time, the temporary application of backing material 1 may be accomplished by the application of a lapped flat seam at several points to the backing using round holes 6; however, as shown in FIG. 3, in the case in which tile is applied to a horizontal surface, arrangement of the tiles alone will suffice. Furthermore, should it be necessary to connect backing materials 1, as shown in FIGS. 3 and 4, a coupling member 10 having formed therein projections 10a which engage round holes 6 and which have the same spacing as round holes 6 may be applied to the continuation of backing material 1.

Next, when allocation has been determined, in the temporary application state of backing material 1, an adhesive S such as cement paste or the like is caused to flow into the regions R of backing material 1, and tiles T are inlaid. Tiles T are inlaid against the same side (for example, in FIG. 1, the left hand upper side) within regions R.

At this time, as shown in FIG. 3, adhesive S is capable of outflow by way of the above notches 3*a* and 3*b* into the peripheral regions R, so that a large amount of adhesive S may be caused to flow into all regions R, and there is no need to pay particular attention to the amount of adhesive S in each region R.

Furthermore, at the time of the inlaying of tiles T, dividing plate portions 3 function as positioning guides for tiles T and even if, for example, laying surface F is a vertical surface, tiles T will be reliably supported by dividing plate portions 3 until the hardening of adhesive S, so that tiles T will not change in position or fall out.

In addition, after all tiles T have been inlaid and, where necessary, the curing of adhesive S has been completed, as shown in FIG. 5, the filling of the joints may be accomplished by means of a joint filling agent M such as, for example, white mortar, or the like.

In positions near walls and the like, where backing material 1 has been cut at the time of allocation in accordance with the requirements of the site, and a nonstandard size results, the cutting and laying of the tile in accordance with the dimensions of the region is identical to that which was conventionally conducted.

As is apparent from the preceding explanation, by the use of the above-described backing material 1, effects are achieved such that tile application can be easily conducted even by an unskilled worker, as operational skill is no longer required, and moreover, a finished form is achieved in which the joints follow dividing plate portions 3 in a pleasing manner, and a tiled floor can be achieved in which the tiles are firmly attached to the backing.

That is to say, by means of this backing material 1, penetrating holes 4 and 6 are provided in base portion 2, so that the space between tiles T and laying surface F is not isolated by backing material 1, and the adhesive S of tiles T passes through these penetrating holes 4 and 6 and flows above laying surface F and to the rear side of backing material 1. As a result, as shown in FIG. 5, tiles T are partially directly adhered to laying surface F, that is to say, to the foundation on which tiles T are to be applied, and moreover, backing material 1 also adheres to the foundation by means of this adhesive. Accordingly, the temporarily applied backing material 1 and the tiles T are together reliably attached to the foundation.

Furthermore, this backing material 1 has in every portion thereof a cross section which is extremely small in comparison with that of conventional backing material, such as a tile mat, so that it has characteristics such that deformations occurring as a result of temperature fluctuation and the like are few, and long-term maintenance is simple.

Figure 6:
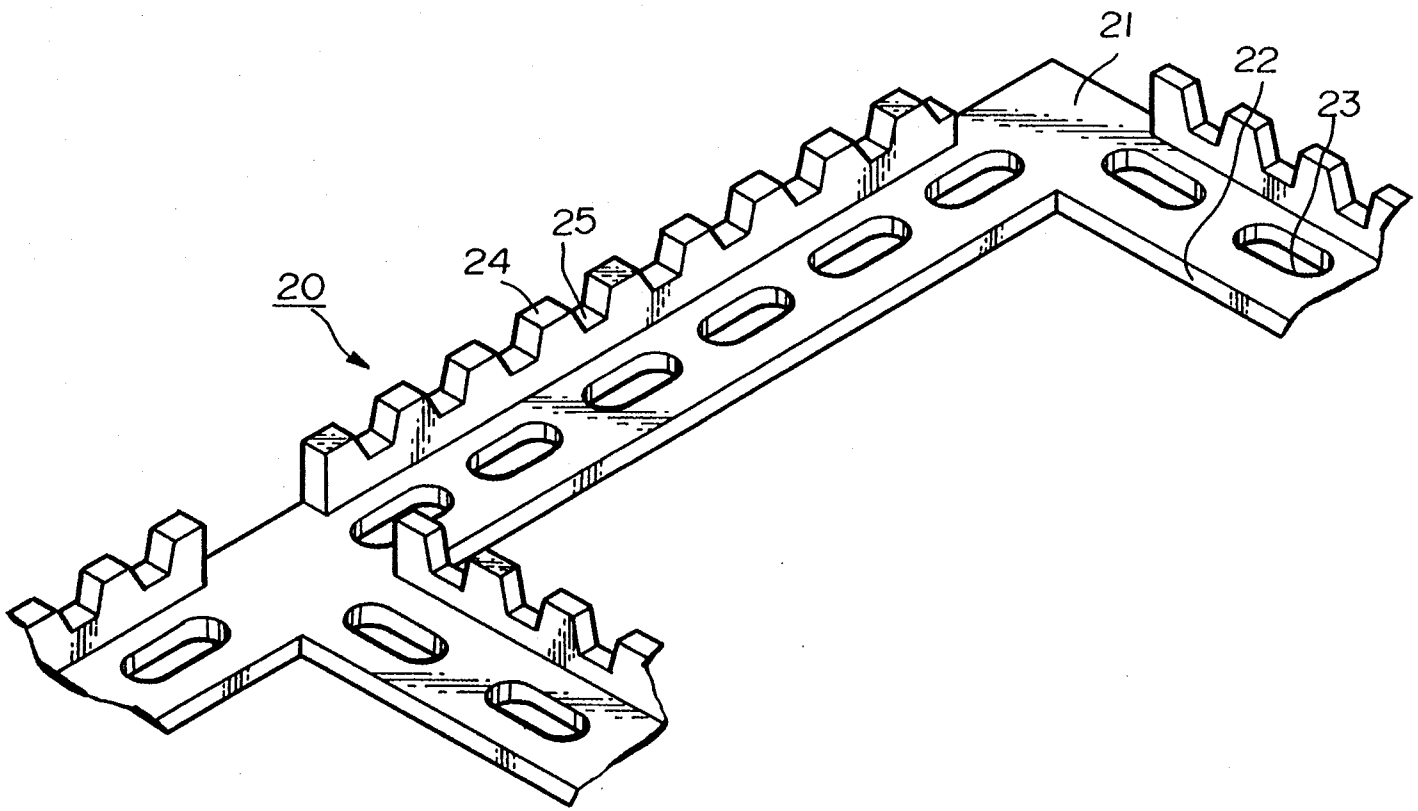
FIG. 6 is an elevated view of a backing material which indicates the state of the tile application backing material.

Various modifications of the present invention are possible. For example, as shown in FIG. 6, a backing material 20 is possible in which the penetrating holes 23 around the circumference of angular hole 22 in base portion 21 are elliptical in shape, and the notches 25 in dividing plate portions 24 are narrow and do not divide dividing plate portions 24.

Figure 7:
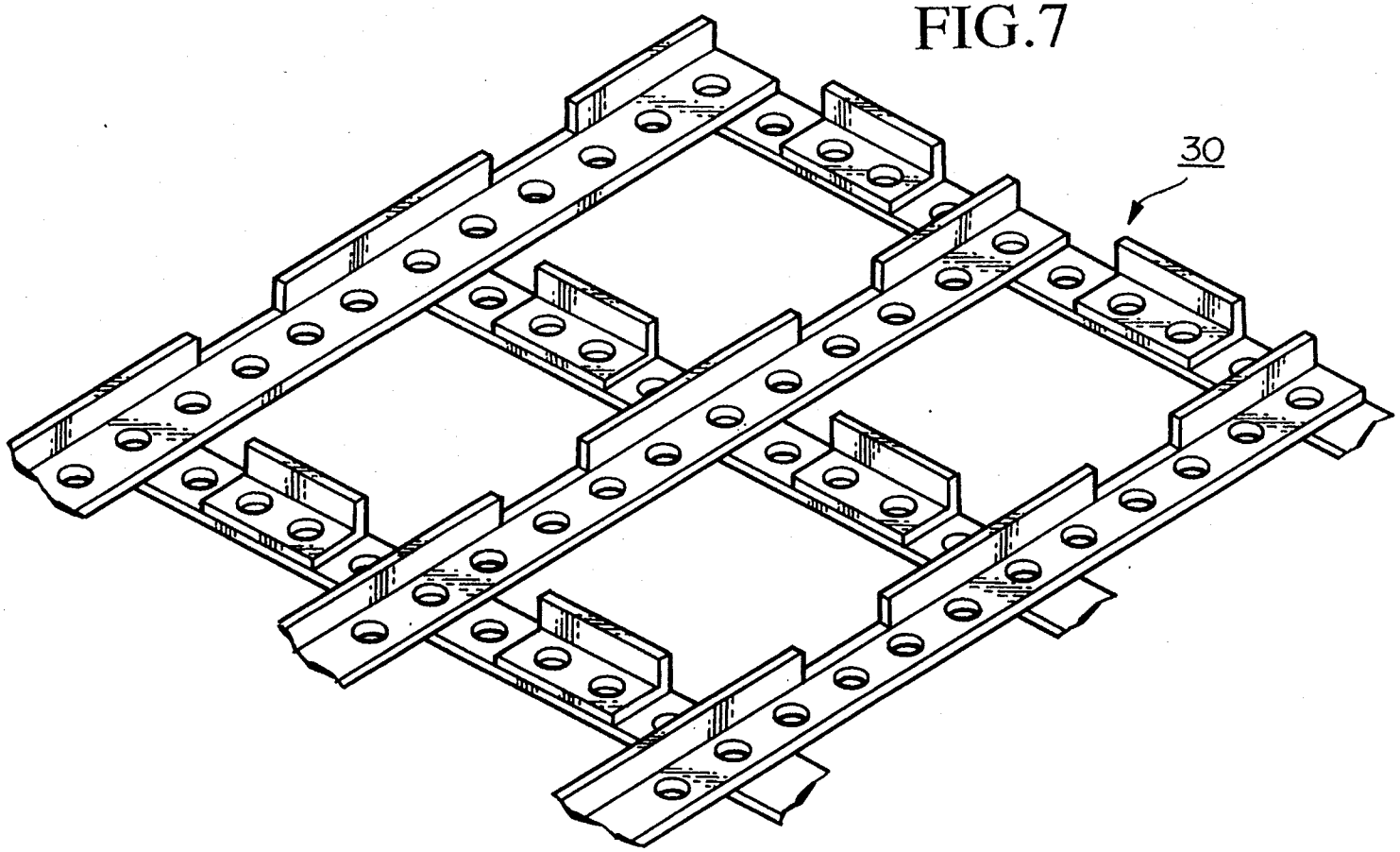
FIG. 7 is an elevated view of the backing material which indicates the state of the tile application backing material.
Figure 8:
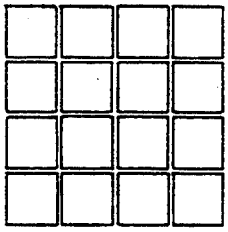
FIGS. 8–25 are top views showing modifications of the tiles of the first preferred embodiment.
Figure 9:
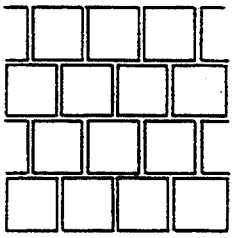
Figure 10:
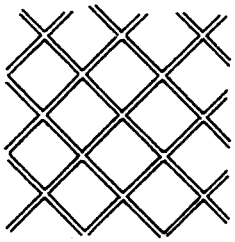
Figure 11:
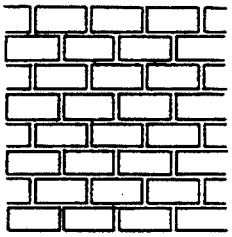
Figure 12:
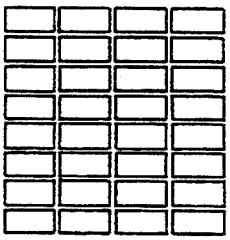
Figure 13:
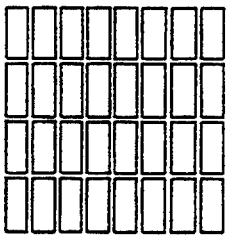
Figure 14:
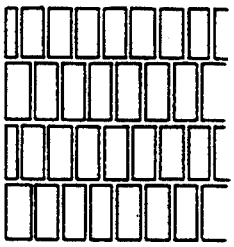
Figure 15:
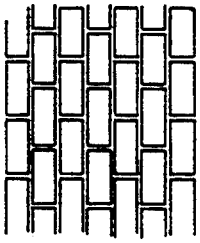
Figure 16:
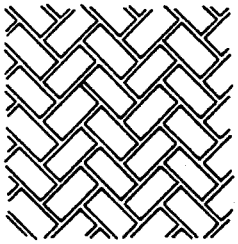
Figure 17:
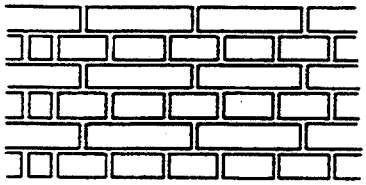
Figure 18:
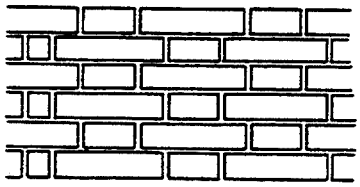
Figure 19:
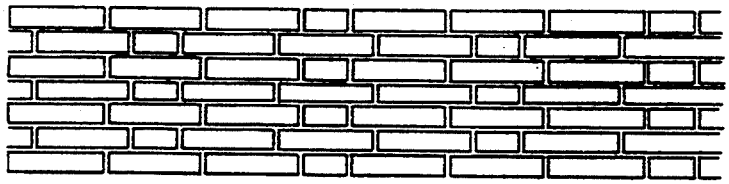
Figure 20:
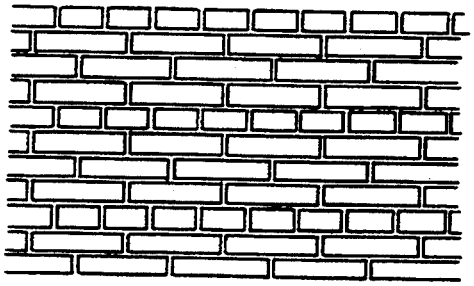
Figure 21:
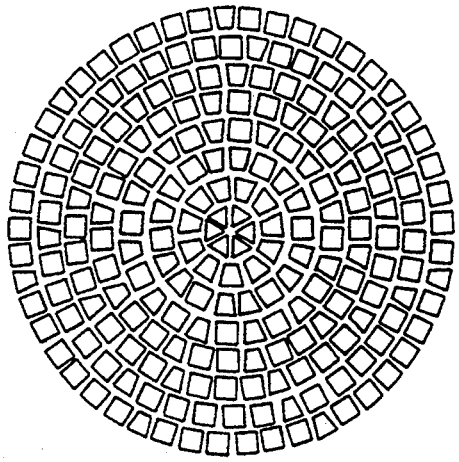
Figure 22:
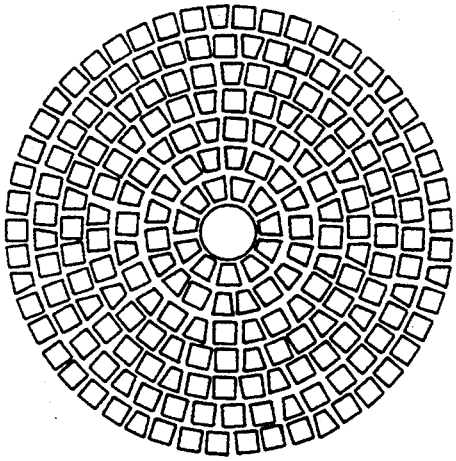
Figure 23:
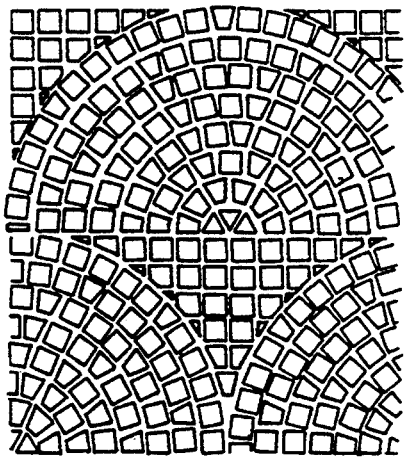
Figure 24:
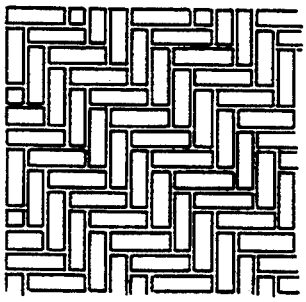
Figure 25:
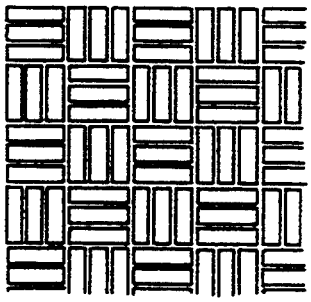

Furthermore, the invention is not limited to a structure having an integral formation; for example, as shown in FIG. 7, a backing material 30 is possible which has a structure identical to that of the above backing material 1 constructed by means of the assembly of a plurality of extrusion molded parts.

In addition, the form of the base portions and the form created by the dividing plate portions are not limited to those of the above-described backing material 1; rather, by means of the alteration thereof, the tile applications having the various joint divisions shown in FIGS. 8–25 are capable of exhibiting identical effects.

Figure 26:
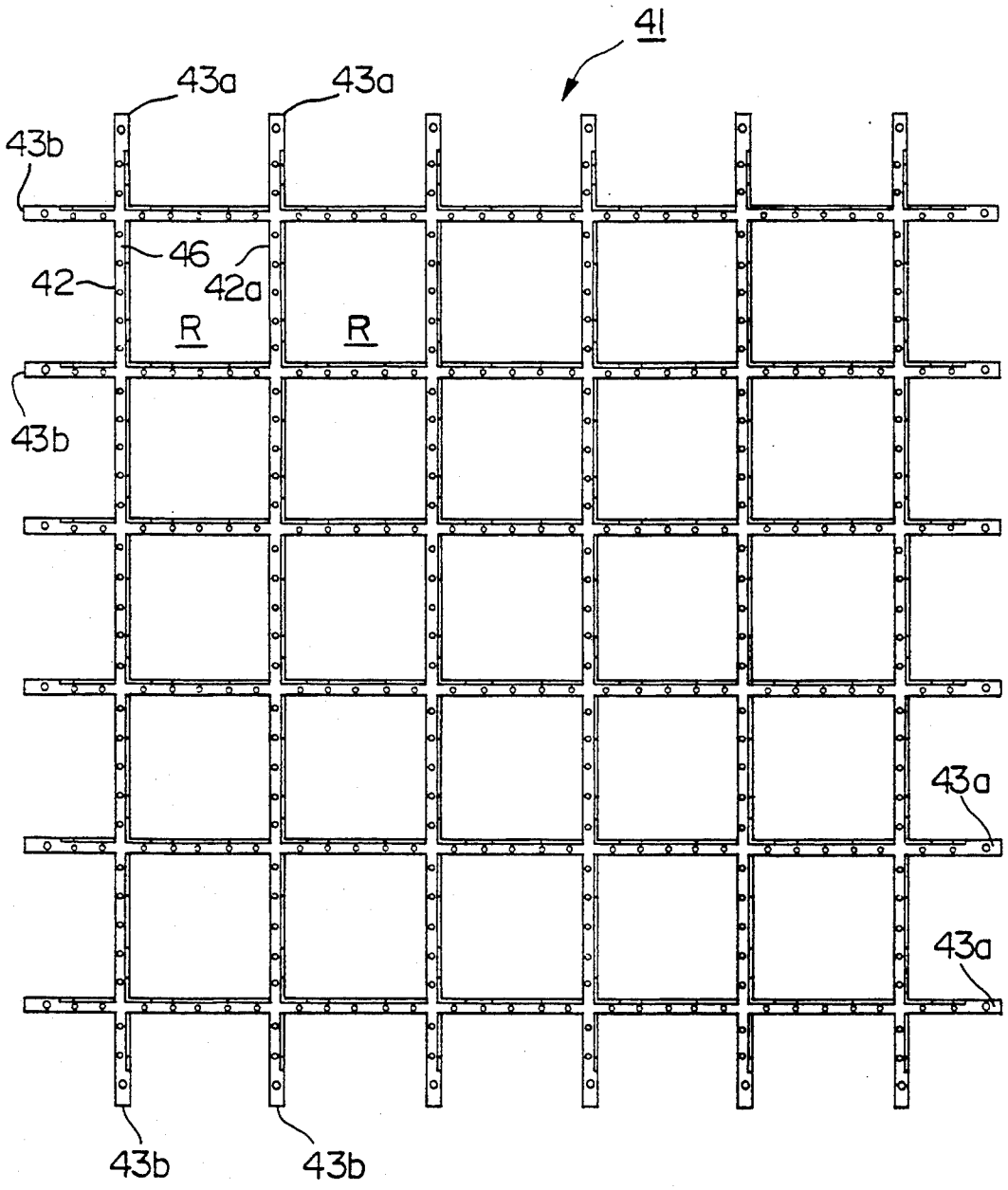
FIGS. 26–29 show the second preferred embodiment.
Figure 27:
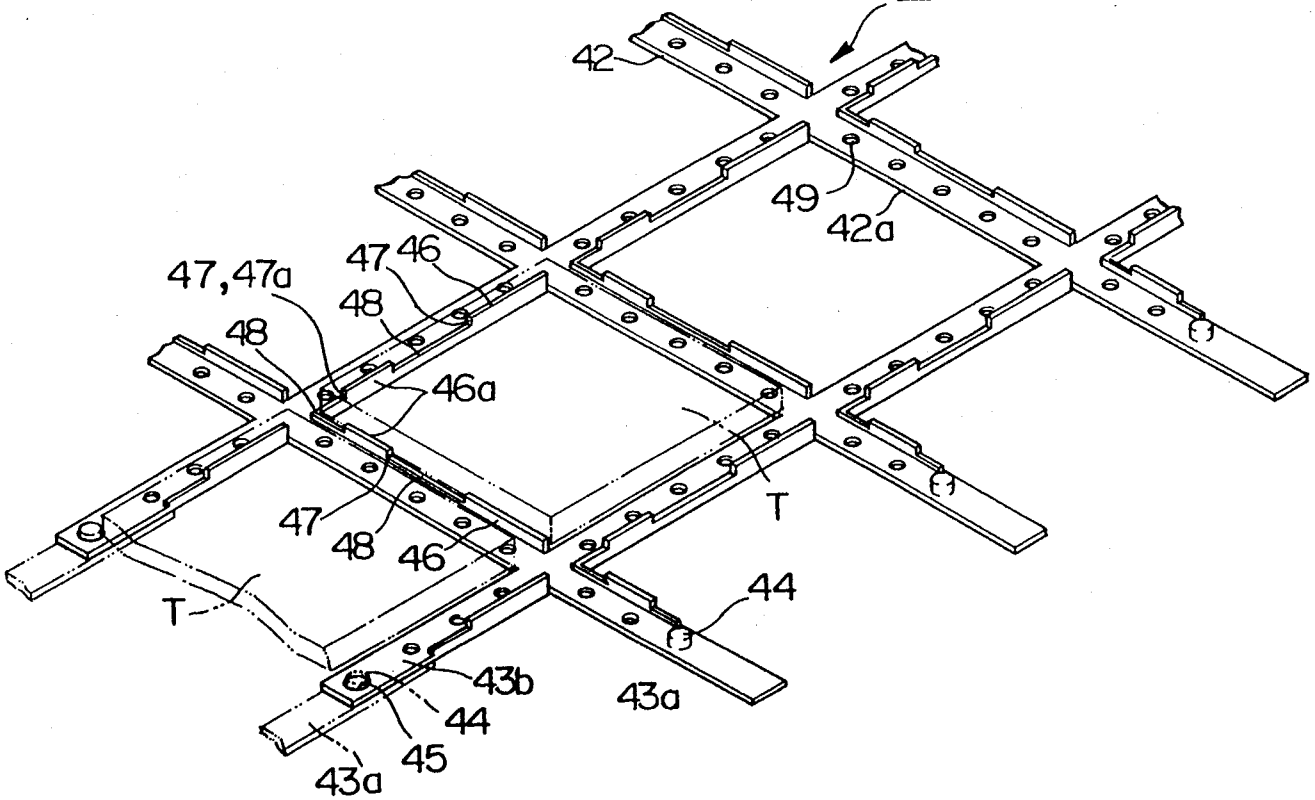

Next, a second preferred embodiment will be explained based on FIGS. 26–27. In the diagrams, reference numeral 41 indicates a tile application backing material. This tile application backing material 41 is, for example, formed by means of injection molding; the base portion 42 is formed with an overall lattice shape having angular holes (penetrating holes) 42*a*, as in the case of the above preferred embodiment. At the side portions of this base portion 42, continuation portions 43*a* and 43*b* which extend the belt plate form portions of the base portion 42 forming this lattice, are integrally formed. The continuation portions 43*a*, which are on one side among these continuation portions 43*a* and 43*b*, have formed thereon projecting portions 44, which projection in a direction of separation from laying surface F, and the continuation portions 43b on the other side have formed therein engaging holes 45 for engaging the above projecting portions 44.

Figure 28:
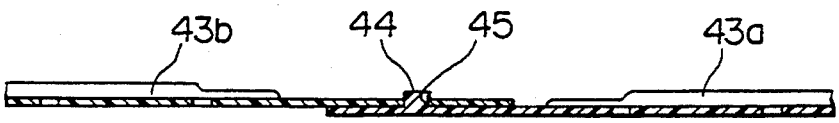

That is to say, by means of engaging engaging holes 45 of continuation ports 43*b* of a backing material 41 with the projecting portions 44 of the continuation portions 43*a* of a neighboring backing material 41, as shown in FIG. 28, the belt plate form portion forming the lattice shape of a base portion 42 of one backing material 41 is connected in a straight-line manner to the belt plate form portion of a base portion 42 of another backing material 41, so that a plurality of backing materials 41 and 41 can be connected with one another. In addition, by means of mutually connecting a plurality of backing materials 41 and 41, rectangular regions R into which tiles T can be placed are formed in these connected portions.

Furthermore, in the same way as in the above preferred embodiment, dividing plate portions 46 are formed in this backing material 41 as well, and notches 47 are formed in these dividing plate portions 46. Accordingly, at the time of application of tiles T, excess adhesive S flows to other regions R, so that there is no need to pay particular attention to the amount of adhesive S flowing into each region R.

Furthermore, in this backing material 41, a step portion 48 extending between dividing plate portions 46 is integrally formed in notch 47. By means of this, the reduction in rigidity of base portion 42 resulting from the notching of dividing plate portions 46 is suppressed, and excellent rigidity can be ensured.

Furthermore, as in the above preferred embodiment, a plurality of round holes (penetrating holes) 49 are formed in the belt plate form portion in this base portion 42, so that at the time of inflow of adhesive S for the application of tiles T, this adhesive S flows into round holes 49 and backing material 41 and laying surface F thus adhere well to each other. In addition, in accordance with the backing material 41 of the above second preferred embodiment, by means of the connection of connecting portions 43*a* and 43*b* of base portion 42 of backing material 41 with connecting portions 43*a* and 43*b* of base portion 42 of another backing material 41, the side portions of base portions 42 are extremely well connected, and it is possible to utilize a plurality of backing materials 41 in a mutually connected manner. In addition, by means of the simple connection of the side portions of these base portions 42 in this manner, it is possible to extremely easily place the belt plate form portions of the base portions 42 in a straight line state. Furthermore, by means of the inflow of adhesive S into regions R of backing material 41 which are connected in this manner and the subsequent inlay of tiles T, tiles T can be extremely easily arranged in a regular fashion and attached to laying surface F. Accordingly, the efficiency of the laying of tiles T is greatly increased.

Furthermore, in the case in which a small tile T of approximately the width of the belt plate form portion of base portion 41 is attached, the side portion of this tile T is placed against side surfaces 46*a* and 46*a* on one side of dividing plate portions 46, and positioning is conducted so that the angled portion of tile T is placed in the notch 47*a* formed in the angled portion. By doing this, tile T is disposed at a position which is separated from the upper portion of the belt plate form portion of base portion 42, and the belt plate form portion of base portion 42 is positioned between tiles T.

By means of this, in the regions R formed at the connection locations of base portions 42 at the time of application of tiles T, by means of the interference of the bottom surfaces of tiles T and projecting portions 44 of the above connecting portions 43*a*, it is possible to eliminate the possibility of the occurrence of faults such as the lifting of tiles T or the like.

Figure 29:
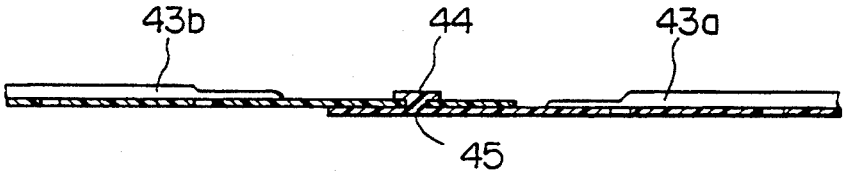
Figure 30:
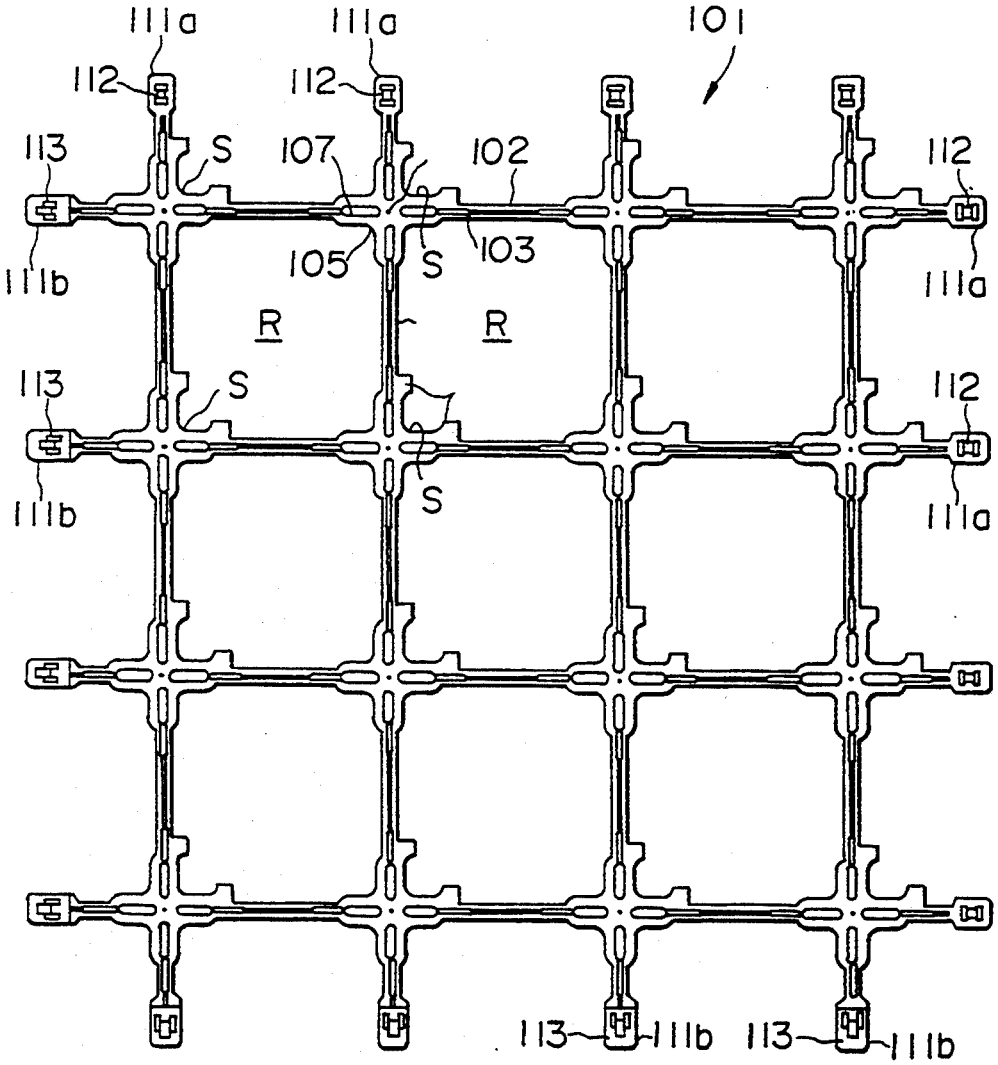
FIG. 30 is a top view showing the tile application backing material of the third preferred embodiment of the present invention.
Figure 31:
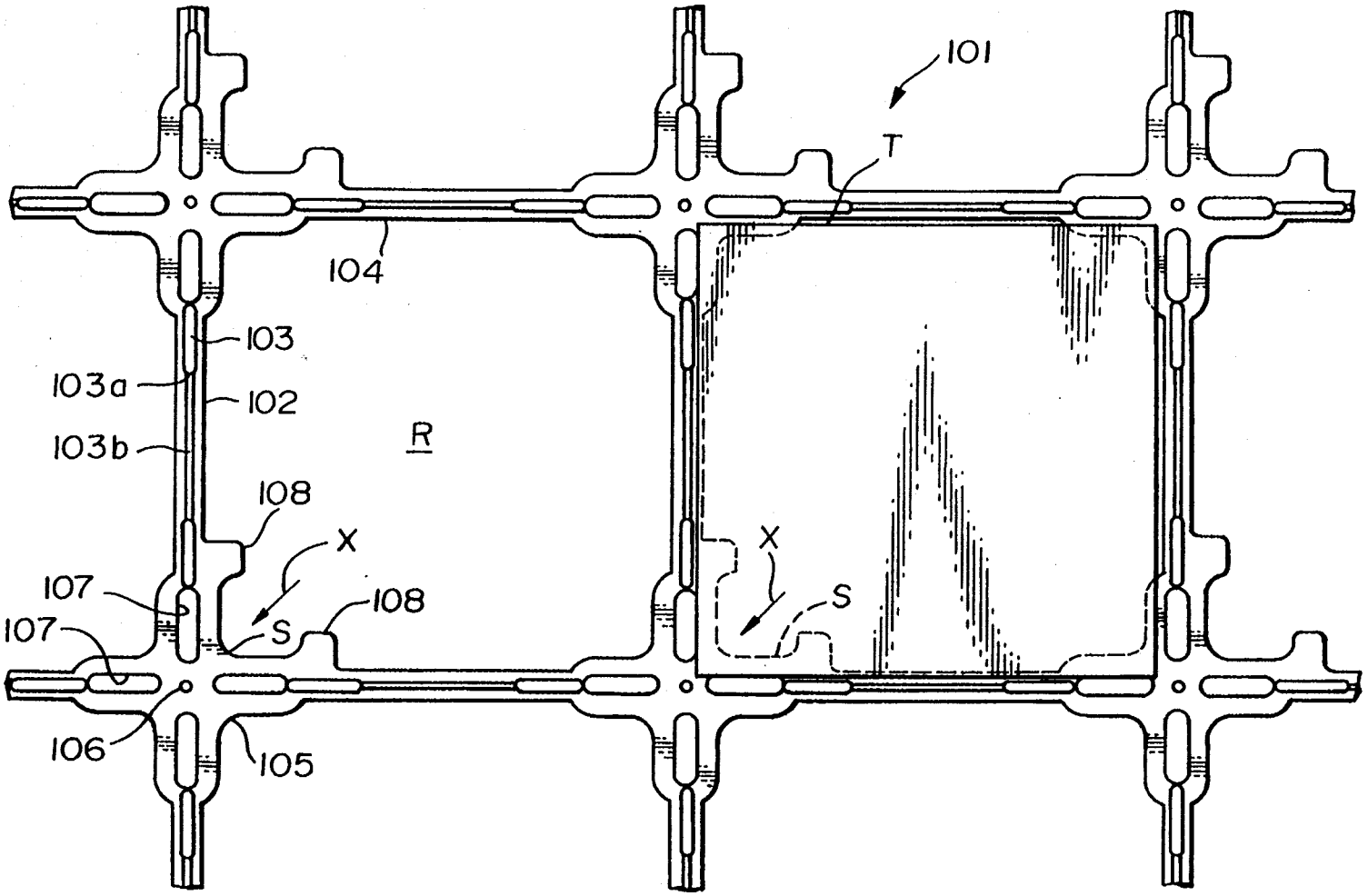
FIG. 31 is a top view of this backing material in which a portion of the backing material has been enlarged.

Furthermore, after engaging the engaging holes 45 of connecting portions 43*b* of a backing material 41 with projecting portions 44 of connecting portions 43*a* of another backing material 41, by using, for example, a tool such as pliers or the like, as shown in FIG. 29, to flatten projecting portion 44, and then caulking this, it is possible to strongly connect the various connecting portions 43*a* and 43*b*, and at the time of the application of tiles T, by means of the interference of the bottom surface of tiles T and projecting portions 44, the danger of the occurrence of faults such as the lifting away of tiles T is eliminated.

The projecting portions 44 formed on connecting portions 43*a* of backing material 41 project in the direction of separation from the laying surface F; however, it is possible to form these projecting portions 44 so as to project in the direction of laying surface F, and to conduct connection by means of the engaging of engaging holes 45 of connecting portions 43*b* with these projecting portions 44.

Furthermore, in the backing materials 1, 20, and 41 of the above preferred embodiments, a plurality of round holes 6, 23, and 48 were formed in the various base portions 2, 21, and 42 in order to increase the adhesion function with laying surface F; however, it is acceptable to form a plurality of angular holes or notches, as identical effects can be obtained.

Furthermore, other preferred embodiments of the tile application backing material of the present invention will be explained.

FIGS. 30–34 are top views showing a tile application backing material in accordance with a third preferred embodiment of the present invention.

In the diagrams, reference numeral 101 indicates a tile application backing material (hereinbelow termed "backing material"). This backing material 101 is integrally formed by, for example, injection press molding, vacuum molding or the like, and comprises a base portion 102, which is applied to the laying surface to which tiles T are to be applied, and dividing plate portions 103, which are provided vertically above this base portion 102. Dividing plate portions 103 demarcate a plurality of regions R which are slightly larger than the tiles T which are to be applied, and penetrating holes 104 are formed in the base portion 102 within the regions R demarcated by means of the dividing plate portions 103. That is to say, backing material 101 is formed with an overall lattice shape.

The locations at which the band plate form portions comprising the lattice shape of the base portion 102 of the backing material 101 intersect are formed as plate portions or planar cross-shaped portions 105, which are formed with a cross shaped plate form, and pin holes 106 are formed at the central position of the cross of these plate portions 105. Furthermore, elongated holes 107 are formed along the cross in these plate portions 105. In penetrating holes 104 of base portion 102, in the vicinity of the corner portion S lying in one direction, a guide lip 108 which extends in the inner direction of angular hole 104 from the various belt plate form portions is formed. In addition, this guide lip 108 accommodates the angled portion of tile T, thus conducting positioning in the corner portion S in which the guide lip 108 is formed. That is to say, by means of this guide lip 108, the positioning direction of tile T (the direction indicated by the arrow marked "X" in FIG. 31) can be verified at a glance.

Dividing plate portions 103 are formed with such a height that they are covered by the joints of tiles T when tiles T are inlaid in regions R, so that in the central portion thereof, notches 103*a* are formed. Furthermore, in notches 103*a*, step portions 103*b* are integrally formed, and the decrease in rigidity of backing material 101 resulting from the notching of dividing plate portions 103 is suppressed, and excellent rigidity is ensured.

Figure 32A:
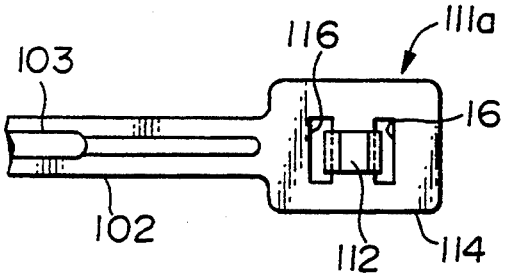
FIG. 32 explains the shape of the projecting connecting portion; (A) is a top view of the projecting connecting portion, while (B) is a side cross sectional view of the projecting connecting portion.
Figure 32B:
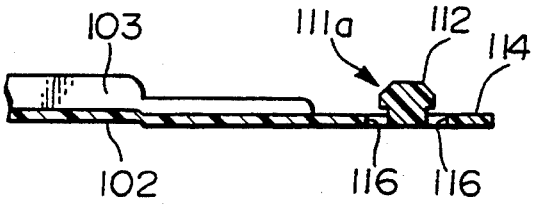
Figure 33A:
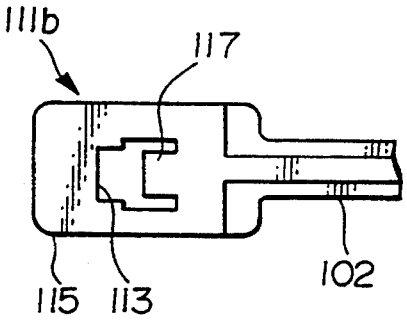
FIG. 33 explains the shape of the engaging connecting portion; (A) is a top view showing the engaging connecting portion, while (B) is a side cross sectional view of the engaging connecting portion.
Figure 33B:
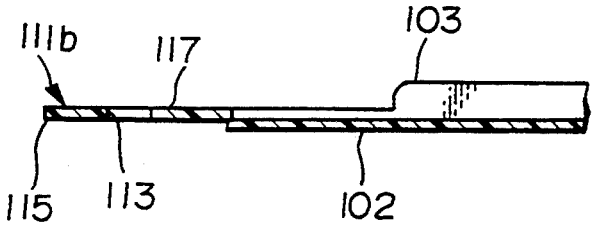

Connecting portions 111*a* and 111*b*, which extend the belt plate form portions of base portion 102 forming a lattice, are integrally formed at the side portions of the base portion 102 of this backing material 101. On the side of one side portion among these connection portions 111*a* and 111*b*, as shown in FIGS. 32(A) and (B), projecting connecting portions 114 having projecting portions or upstanding tabs 112 which project in a direction of separation from the laying surface are formed, and on the side of the other side portion, as shown in FIGS. 33(A) and (B), engaging connecting portions 119, having engaging holes 113 for engaging the above projecting portions 112, are formed. That is to say, by means of engaging the engaging holes 113 of engaging connecting portions 115 of a backing material 101 with the projecting portions 112 of the projecting connecting portions 114 of another backing material 101, the belt plate form portions comprising the lattice form of the base portion 102 of a backing material 101 are connected in a straight line with the belt plate form portions of the base portion 102 of another backing material 101, and a plurality of backing materials 101 can be mutually connected. In addition, by means of the mutual connection of a plurality of backing materials 101, rectangular regions R, which are capable of accepting tiles T, are formed in these connection portions as well.

Figure 34:
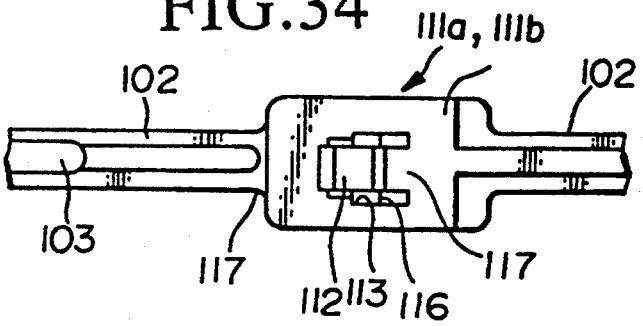
FIG. 34 is a top view of the connecting portion which explains the state in which the projecting connecting portion and engaging connecting portion are connected.

Hole portions 116 are formed in the vicinity of the side portion of projection portions 112 of projecting connecting portions 114, and in the state in which the engaging holes 113 of engaging connecting portions 115 are engaged with and connected to the projecting portions 112 of this projecting connecting portion 114, as shown in FIG. 34, this hole portion 116 communicates with the engaging holes 113 of the engaging connecting portions 115. The projecting portions 112 formed in the projecting connecting portions 114 are constricted in the vicinity of the lower portion thereof, and by means of the engaging of engaging holes 113 of the engaging connecting portions 115 with these projecting portions, these engaging holes 113 are connected to the constricted area of the projecting portions 112. Suspending lip 117 is formed in the engaging holes 113 of the engaging connecting portions 115, and when the engaging holes 113 are engaged with the projecting portions 112, a reliable connected state of the projecting portions 112 and the engaging holes 113 is thus ensured.

In the regions R formed by means of the connection of the connecting portions 111*a* and 111*b*, when the tiles T are laid so that the angled portion thereof is aligned with the corner portion S in which the guide lip 108 is formed, these connecting portions 111*a* and 111*b* are disposed so as to be positioned between tiles T. That is to say, these connecting portions 111*a* and 11*b* are formed at a position which is slightly displaced from a position which is directly above the belt plate form portions of the base portion 102 comprising a lattice.

Using a backing material 101 having the above structure, a method for the conducting of tile application on the floor (laying surface) of a building will be explained.

(1) First a backing material 101 is arranged and temporarily fixed to the floor, an assumption is made as to the finished form, and allocation is conducted. At this time, by means of the insertion of pins through the pin holes 106 formed in the center of the plate portions 105 of the backing material 101 and into the laying surface, the temporary attachment of this backing material 101 can be easily accomplished. In the case in which tiles T are to be laid on a horizontal surface, the simple arrangement of the backing material 101 will suffice. In the case in which the laying surface of tiles T is large, a plurality of backing materials 101, 101 may be connected at the connecting portions 111*a* and 111*b* thereof.

(2) Next, an adhesive such as, for example, cement paste, or the like, is caused to flow into the regions R of the backing material 101, and the angled portions of tiles T are moved in the direction of corner portion S, in which guide lip 108 is formed, of base portion 102, that is to say, in the positioning direction (the direction indicated by the "X" arrow in FIG. 31), until side parts of tiles T and dividing plate portions 103 are placed in contact.

Here, when the angled portion of a tile T is moved to the corner portion S of base portion 102, the guide lip 108, which is formed extending in an interior direction of penetrating holes 104 formed in the belt plate form portion of base portion 102, is inserted between tile T and the laying surface, and thereby, tile T is placed on base portion 102. That is to say, by means of the mutual contact of the side portion of a tile T and the side portion of base portion 102, positioning defects are prevented, and it is possible to reliably place the side portion of a tile T against the side portions of dividing plate portions 103, thus conducting positioning.

Angular holes 104 and elongated holes 107 are formed in this backing material 101, so that adhesive reliably flows to the floor surface from these angled holes 104 and elongated holes 107, and the adhesion of the backing material 101 to the floor surface is reliable.

Furthermore, the above connecting portions 111*a* and 111*b* are disposed so as to be positioned between tiles T so that by means of the interference between the bottom surface of these tiles T and the connecting portions 111*a* and 111*b*, faults such as the lifting away of tiles are prevented.

Adhesive is capable of flowing out through the notches 103*a* formed in the center portion of dividing plate portions 103 to the peripheral regions R, so that it is acceptable to introduce a large amount of adhesive so that adhesive flows into all regions R, and it is not necessary to pay particular attention to the amount of adhesive R.

(3) In addition, after all tiles T have been inlaid, the pins which were inserted through pin holes 106 into the floor surface for the purpose of temporary attachment have been removed, and where necessary, time has been allowed to elapse for the curing of the adhesive, joint filling is conducted by filling joints between tiles T with a joint filling agent, for example, white mortar, or the like.

In a case in which, as a result of adjustment to the site at the time of allocation, the backing material 101 has been cut in the vicinity of a wall, and thus a region R is not of a standard size, the cutting and inlaying of a tile T in accordance with the dimensions of this region R is identical to that conducted in conventional methods.

As explained above, in accordance with the backing material 101 of this preferred embodiment, after the determination of allocation by means of this backing material 101, in the state in which this backing material 101 is temporarily attached to a floor surface, adhesive is caused to flow into a plurality of regions R demarcated by means of dividing plate portions 103, and tiles T are inlaid, and by means of this, tile application can be conducted in an extremely simple and reliable manner.

Furthermore, when tiles T are inlaid into regions R demarcated by means of dividing plate portions 103, the guide lips 108 formed in corner portions S of the penetrating holes 104 of the base portion 102 are positioned between the tiles T and the floor surface. That is to say, these guide lips 108 are in a state in which they are inserted between tiles T and the floor surface, so that as a result of the contact of the side surface of the tiles T and the side surface of the base portion 102, positioning defects do not occur, the tiles T are reliably laid on the base portion 102, and in regions R, the side portions of the tiles T and the side portions of the dividing plate portions 103 are reliably placed in contact, and positioning can thus be conducted.

Figure 35:
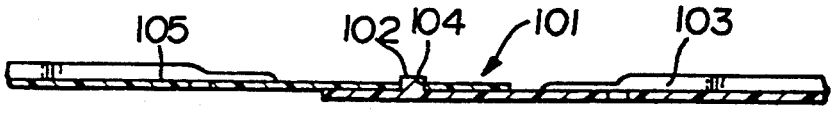
FIG.35 (PRIOR ART)
FIG. 35 is a side cross sectional view of the connecting portion which explains the connected state of the connecting portions of a conventional tile application backing material.

Furthermore, in the connecting portions 111*a* and 111*b* of the various backing materials 101, the engaging holes 113 of the projecting connecting portions 114 are in a state in which they communicate, so that, in contrast with the conventional case shown in FIG. 35, at the time of the inflow of the adhesive for the attachment of the tiles T, this adhesive passes through the engaging holes 113, which are in a communicating state, and through the hole portions 116, and flows to the laying surface, so that it is possible to ensure a reliable adhesive state of the connecting portions 111*a* and 111*b* to the laying surface. By means of this, the occurrence of faults such as the detachment of the connecting portions 111*a* and 111*b* from the laying surface, or the like, can be prevented, and it is possible to reliably conduct tile application to a laying surface over a wide area. That is to say, skill in the operation is not necessary, so that even an unskilled worker can easily conduct the laying operation of tiles T, and the operational efficiency of the laying operating of tiles T is greatly increased. Moreover, an extremely good finished form can be obtained for the laid form of the tiles T, in which the joints thereof are regular and run along dividing plate portions 103. Furthermore, guide lips 108 are formed in the corner portions S on the same directional side of the penetrating holes 104 of base portion 102, so that it is possible to verify the positioning direction of tiles T in an extremely easy manner.

Figure 36:
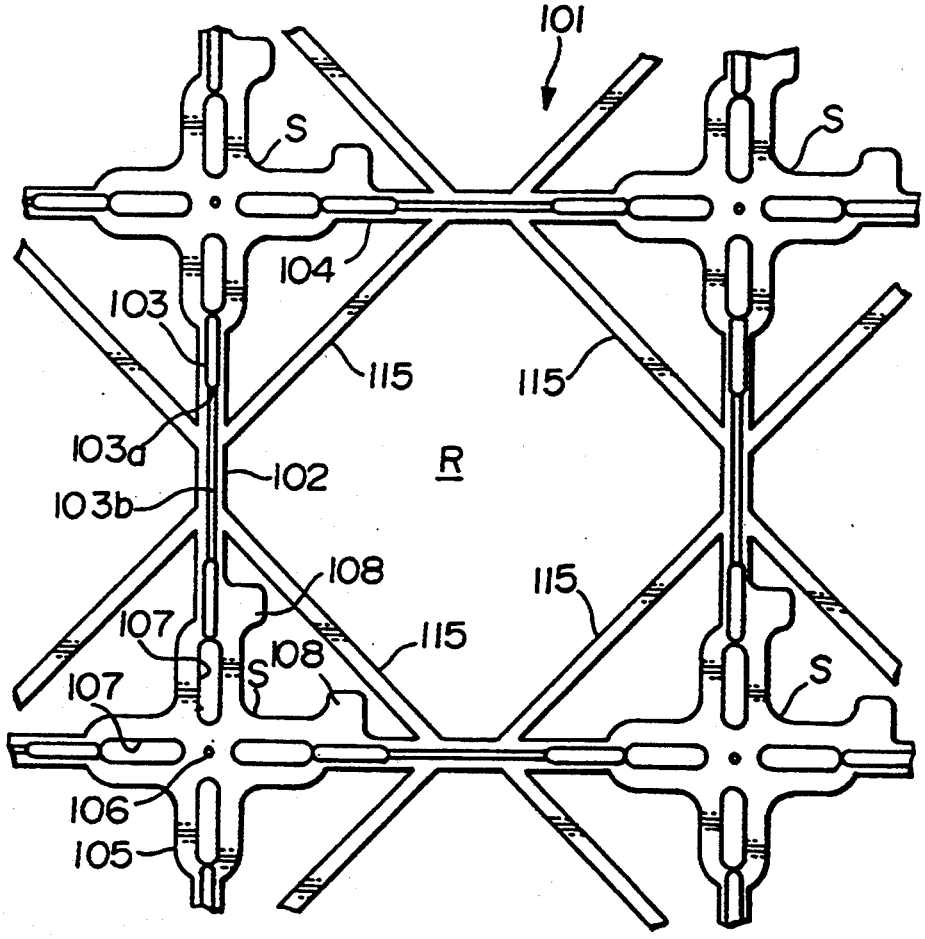
FIG. 36 is a top view of the backing material having ribs of the fourth preferred embodiment of the present invention, in which a portion of the backing material is depicted in an enlarged state.

A fourth preferred embodiment of the present invention is shown in FIG. 36; in order to increase the rigidity of the backing material 101 of the above preferred embodiments, ribs 115 which extend between mutually neighboring side portions of base portion 102 are formed in penetrating holes 104 of base portion 102. In this manner, by means of providing ribs 115 in penetrating holes 104, the rigidity of backing material 101 is increased, deformations in backing material 101 at the time of the installation operation of backing material 101 on a floor surface are prevented, and it is possible to further increase the ease of operation of the installation operation. It is of course possible to increase the rigidity of backing material 101 in a manner identical to that given above even if cross shaped ribs are so formed in the penetrating holes 104 of the base portion 102 as to connect opposing side portions of the base portion 102.

The number and size of the regions R in which tiles T are inlaid of the backing materials 101 of the above preferred embodiments are not limited to those given in the preferred embodiments. Furthermore, in the above preferred embodiments, penetrating holes 104 exist in each region R; however, these penetrating holes are not limited to that shown in the preferred embodiments, so that, for example, holes with a rectangular or trapezoidal shape are of course possible.

Figure 37:
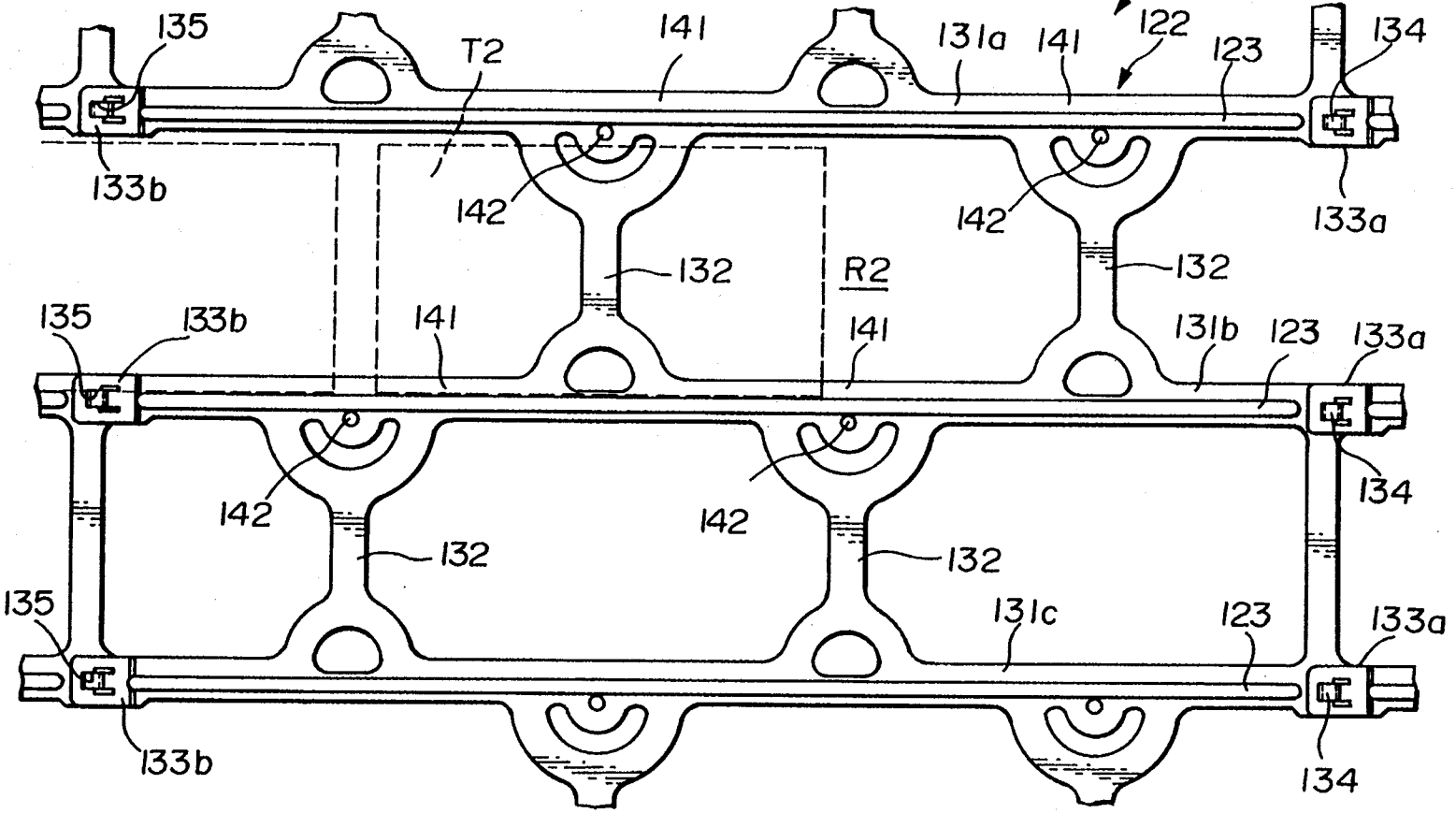
FIG. 37 is a top view showing the tile application backing material of the fifth preferred embodiment of the present invention.

FIG. 37 is a top view showing a tile application backing material in accordance with a fifth preferred embodiment of the present invention.

In the diagram, reference numeral 121 indicates a tile application backing material. This backing material 121 is formed integrally, as in the case of the backing material 101 of the first and second preferred embodiments, and is comprising a base portion 122 which is applied to a laying surface to which tiles T2 are to be applied, and dividing plate portions 123 which are provided vertically above this base portion 122. In base portion 122, a plurality of horizontal joint portions 131 having an elongated plate shape are arranged in parallel on the same surface; and between neighboring horizontal joint portions 131*a* and 131*b*, vertical joint portions 132, 132, . . . , which connect the horizontal joint portions 131*a* and 131*b* in a direction perpendicular to these horizontal joint portions 131*a* and 131*b*, are provided at equal intervals. Furthermore, between neighboring horizontal joint portions 131*b* and 131*c* as well, vertical joint portions 132, 132, . . . , which connect horizontal joint portions 131*b* and 131*c* in a direction perpendicular to these horizontal joint portions 131*b* and 131*c*, are provided at positions which are central points between the vertical joint portions 132, 132, . . . , between the above horizontal joint portions 131*a* and 131*b*. Below this, in the same manner, vertical joint portions 132, 132, . . . , are provided between horizontal joint portions 131*c*, 131*d*, . . . , as well, in accordance with the above stipulations.

At both end portions of these horizontal joint portions 131*a*, 131*b*, . . . , connecting portions 133*a* and 133*b* are integrally formed. In connecting portions 133*a*, which are on the side of one side portion among these connecting portions 133*a* and 133*b*, projecting portions 134, which project in a direction of separation from the laying surface, are formed, and in the connecting portions 133*b* on the side of the other side portion, engaging holes 135 for engaging these projecting portions 134 are formed. That is to say, by engaging the engaging holes 135 of the connecting portions 133*b* of the horizontal joint portions 131*a*, 131*b*, . . . , of a backing material 121 with the projecting portions 134 of the connecting portions 133*a* of the horizontal joint portions 131*a*, 131*b*, . . . , of a neighboring backing material 121, one backing material 121 and another backing material 121 are connected in a straight line, and a plurality of backing materials 121, 121 can be connected to one another. In addition, by means of the vertical and horizontal connection of a plurality of backing materials 121, 121, regions R2, having a roughly rectangular shape in which tiles 122 can be installed, are formed vertically and horizontally in the connection portions thereof.

Dividing plate portions 123 are formed above the horizontal joint portions 131*a* (131*b*, . . . ) of the base portion 122 and along the longitudinal direction of the horizontal joint portions 131*a* (131*b*, . . . ,) and demarcate a plurality of regions R2 which are slightly larger than the tiles T2 which are applied; the dividing plate portions 123 are of such a height as to be covered by the joints of the tiles T2 in the case which the tiles T2 are inlaid in regions R2. In addition, in regions R2 in the base portion 122 demarcated by means of these dividing plate portions 123, approximately rectangular holes (penetrating holes 124) are formed. Furthermore, at the intersecting portions 141 between the horizontal joint portions 131*a*, 131*b*, . . . and the vertical joint portions 132, 132, . . . and at a position neighboring one side surface of the dividing plate portions 123, a hole 142 for fixing the base portion 122 on the above laying surface is formed.

A method for the application of tiles to the wall surface (laying surface) of a building using a backing material 121 having the above structure will be explained.

(1) First, after conducting horizontal setting-out on the wall surface to which tiles T2 are to be applied, backing materials 121 are arranged and temporarily attached in accordance with this setting-out. An approximation is made of the finished form, and allocation is conducted. At this time, iron nails are inserted into holes 142 formed at intersection portions 141 between horizontal joint portions 131*a*, 131*b* . . . , and vertical joint portions 132, 132 . . . of backing material 121, and are driven into the wall surface. The iron nails are driven in at freely selected points so that the rigidity of backing material 121 can be horizontally maintained. By means of this, it is possible to easily conduct the temporary attachment of backing material 121. In the case in which tiles T2 are to be laid on a horizontal surface such as a floor or the like, a simple arrangement of backing materials 121 will suffice.

(2) Next, on this backing material 121, mortar or adhesive for use with tiles is applied using a rubber trowel, a plastic trowel, or a metal trowel or the like, and the application surface is leveled so that the top portions of the dividing plate portions 123 appear.

(3) Next, tiles T2 are placed at specified positions on base portion 122, and the bottom edge portion of the tiles T2 are fixed in contact with the upper surface of the dividing plate portions 123.

By means of this, tiles T2 are fixed at specified positions on the base portion 122, and because no slippage of the tiles T2 in a downward direction occurs, it is possible to reliably place the lower edge portions of tiles T2 in contact with the upper surface of dividing plate portions 123, so that positioning defects can be prevented. In particular, operations to correct vertical slippage, which often occurred with conventional technologies when heavy tiles T2 were applied, were not necessary, and a more accurate and aesthetically pleasing finished surface can be obtained.

(4) In addition, when all tiles T2 have been applied, the iron nails used for temporary attachment are removed from holes 142, and where necessary, after time has been allowed to elapse for the curing of the tile mortar or tile adhesive, joint filling is conducted by filling the joints between tiles T2 with a joint filling agent such as white mortar or the like.

In cases in which the backing material 121 is cut near the edge portion of a wall surface, and a region R having a nonstandard size results as a result of adjustments at the site at the time of allocation, the cutting and fixing of a tile T2 in accordance with the dimensions of this region R is identical to that which was conventionally conducted.

As explained above, in accordance with the backing material 121 of this fifth preferred embodiment, after allocation has been determined by means of this backing material, by means of the insertion of iron nails into the floor surface through holes 142 of the backing material 121 and the affixing of backing material 121 to the floor surface, the temporary attachment of this backing material 121 is easily accomplished.

Furthermore, in this affixed state, by applying tiles T2 to the plurality of regions R2 demarcated by means of the dividing plate portions 123, tile application can be conducted in an extremely easy and reliable manner. Accordingly, it is possible to greatly increase the operational efficiency of the laying operation of tiles T2. Moreover, it is possible to obtain an extremely good finished state having joints which are regular and follow the dividing plate portions 123.

What is claimed is:

1. A tile application backing material comprising:

a plurality of base portions in contact with a laying surface to which tiles are to be affixed;

a plurality of upstanding dividing plate portions disposed vertically above said base portions and demarcating a plurality of spaces into which polygonal tiles are fitted;

said base portions being substantially planar and defining polygonal penetrating holes in each said space, said base portions cooperating to form a lattice, a plurality of intersection points of said base portions defining planar cross-shaped portions;

said dividing plate portions each having a height which permits said dividing plate portions to be covered by joints between tiles fitted into each said space;

a plurality of notches for inflow and outflow of adhesive formed in said dividing plate portions in upper end sides thereof;

a plurality of connecting portions extending radially away from said lattice, a first group of said connecting portions having free ends thereof defining upstanding tabs and a second group of said connecting portions having free ends thereof defining engaging holes;

said upstanding tabs and said engaging holes being engageable with respective engaging holes and upstanding tabs of an adjacent lattice;

when engaged, said upstanding tabs and said engaging holes cooperating to define hole portions proximate said upstanding tabs which permit adhesive to flow through said hole portions to said laying surface to adhesively bond said connecting portions to said laying surface; and between said adjacent lattices, further polygonal penetrating holes demarcated by said dividing plate portions of each of said lattices are formed.

2. A tile application backing material in accordance with claim 1, wherein said base portions and said dividing plate portions form a cross-sectional inverted T-shape.

3. A tile application backing material in accordance with claim 1, wherein each said penetrating hole includes a plurality of guide lips extending toward a central portion of said penetrating hole from adjacent arms of one of said cross-shaped portions.

4. A tile application backing material in accordance with claim 1, wherein a plurality of elongated holes are formed in said planar cross-shaped portions which permit the inflow of adhesive between said laying surface and said cross-shaped portions.

5. A tile application backing material in accordance with claim 1, wherein in said cross-shaped portions, pin holes are formed for temporarily affixing said base portions to said laying surface by inserting pins thereinto and pounding said pins into said laying surface.

6. A tile application backing material in accordance with claim 1, wherein portions of said base portions in which said dividing plate portions are formed with a cross-sectional L shape.

7. A tile application backing material as claimed in claim 1, wherein within said penetrating holes, ribs are formed extending between adjacent base portions.

8. A tile application backing material as claimed in claim 1, wherein a plurality of elongated holes are formed in said base portions which permit the inflow of adhesive between said laying surface and said base portions.

* * * * *

UNITED STATES PATENT AND TRADEMARK OFFICE

CERTIFICATE OF CORRECTION

PATENT NO. : 5,418,036

DATED : May 23, 1995

INVENTOR(S) : Kazuhiko Tokikawa, Teruo Azuma and Hisakazu Komi

It is certified that error appears in the above-indentified patent and that said Letters Patent is hereby corrected as shown below:

Title page, Item 73, Assignee should be -- Fukuvi Chemical Industry Co., Ltd.

Signed and Sealed this

Fifteenth Day of August, 1995

*Attest:*

Bruce Lehman

BRUCE LEHMAN

*Attesting Officer*

*Commissioner of Patents and Trademarks*